US011643826B1

(12) United States Patent
Troxell

(10) Patent No.: US 11,643,826 B1
(45) Date of Patent: May 9, 2023

(54) WEDGE LEVELING SYSTEM

(71) Applicant: Ronald V. Troxell, Huntington Beach, CA (US)

(72) Inventor: Ronald V. Troxell, Huntington Beach, CA (US)

( * ) Notice: Subject to any disclaimer, the term of this patent is extended or adjusted under 35 U.S.C. 154(b) by 0 days.

(21) Appl. No.: 17/571,503

(22) Filed: Jan. 9, 2022

Related U.S. Application Data

(63) Continuation-in-part of application No. 29/820,815, filed on Dec. 23, 2021.

(51) Int. Cl.
*E04F 21/22* (2006.01)
*E04F 15/02* (2006.01)

(52) U.S. Cl.
CPC ..... *E04F 21/22* (2013.01); *E04F 15/02022* (2013.01)

(58) Field of Classification Search
CPC ... E04F 21/0092; E04F 21/22; E04F 21/1844; E04F 21/1877; E04F 13/0892; E04F 15/02022; E04F 15/02005
See application file for complete search history.

(56) References Cited

U.S. PATENT DOCUMENTS

| | | | |
|---|---|---|---|
| 5,603,195 | A | 2/1997 | Cosentino |
| 7,992,354 | B2 | 8/2011 | Doda, Jr. |
| 8,671,628 | B2 | 3/2014 | Sighinolfi |
| 8,800,246 | B2 | 8/2014 | Gorton |
| 8,887,475 | B2 | 11/2014 | Ghelfi |
| 9,045,911 | B2 | 6/2015 | Hofman et al. |
| 9,260,872 | B2 | 2/2016 | Bunch et al. |
| D760,566 | S | 7/2016 | Biec |
| 9,447,590 | B2 | 9/2016 | Sighinolfi |
| 9,487,959 | B2 | 11/2016 | Bunch et al. |
| 9,534,403 | B2 | 1/2017 | Biec |
| 9,970,203 | B1 | 5/2018 | Abidov et al. |
| D820,059 | S | 6/2018 | Biec |
| D821,838 | S | 7/2018 | Castellanos |
| 10,465,394 | B2 | 11/2019 | Sighinolfi |
| 10,501,947 | B2 | 12/2019 | Bunch et al. |
| D885,862 | S | 6/2020 | Bacia et al. |
| 10,704,274 | B2 | 7/2020 | Bunch et al. |
| 10,704,275 | B2 | 7/2020 | Bunch et al. |
| 10,724,254 | B1 | 7/2020 | Troxell |
| 10,895,081 | B2 | 1/2021 | Mendiluza et al. |
| 10,947,740 | B2 | 3/2021 | Sighinolfi |
| 11,078,674 | B2 | 8/2021 | Troxell |

(Continued)

*Primary Examiner* — Babajide A Demuren
(74) *Attorney, Agent, or Firm* — Kirk A. Buhler; Buhler & Associates Patenting

(57) ABSTRACT

A wedge levelling system for aligning surface coverings includes a tab with a substantially flat base and a vertical member extending away from a central area of the top surface of the base. The base includes beveled feet portions on opposite sides for insertion under lower surfaces of adjacent surface coverings, with the vertical member extending between the tiles. The vertical member is attached to the base with frangible leg. The vertical member includes an opening spaced so as to be above two adjacent tiles. When a wedge is inserted and held in the opening and presses down, the tiles are pushed downwardly toward a surface upon which they are being laid to properly align the edges thereof until the tiles are set, the wedge removed and the vertical member broken off at the frangible leg portions.

10 Claims, 5 Drawing Sheets

(56) References Cited

U.S. PATENT DOCUMENTS

| | | | | |
|---|---|---|---|---|
| 11,105,102 | B2 | 8/2021 | Bunch et al. | |
| 11,124,976 | B2 | 9/2021 | Prestes de Andrade | |
| 2008/0236094 | A1 | 10/2008 | Doda | |
| 2013/0055675 | A1 | 3/2013 | Sighinolfi | |
| 2014/0033640 | A1 | 2/2014 | Gorton | |
| 2014/0116001 | A1* | 5/2014 | Ghelfi | E04F 21/0092 52/749.11 |
| 2014/0298736 | A1 | 10/2014 | Bunch et al. | |
| 2015/0308130 | A1 | 10/2015 | Biec | |
| 2016/0090746 | A1* | 3/2016 | Sighinolfi | E04F 21/0092 33/526 |
| 2016/0186449 | A1 | 6/2016 | Lee | |
| 2016/0222679 | A1 | 8/2016 | Bunch et al. | |
| 2017/0051519 | A1 | 2/2017 | Bunch et al. | |
| 2018/0291640 | A1 | 10/2018 | Sighinolfi | |
| 2019/0048599 | A1 | 2/2019 | Papadatos | |
| 2019/0063084 | A1 | 2/2019 | Bunch et al. | |
| 2019/0169863 | A1* | 6/2019 | Torrents Comas | E04F 21/1877 |
| 2019/0309531 | A1 | 10/2019 | Li | |
| 2019/0383027 | A1 | 12/2019 | Sighinolfi | |
| 2020/0056381 | A1 | 2/2020 | Castellanos | |
| 2020/0063448 | A1 | 2/2020 | Morrow | |
| 2020/0173181 | A1 | 6/2020 | Gorton | |
| 2020/0224434 | A1 | 7/2020 | Troxell | |
| 2020/0347617 | A1 | 11/2020 | Troxell | |

* cited by examiner

WEDGE LEVELING SYSTEM

CROSS REFERENCE TO RELATED APPLICATION

This application is a continuation-in-part of applicant's co-pending application Ser. No. 29/820,815 filed Dec. 23, 2021, the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention generally relates to a wedge leveling system for laying tile and other surface protective coverings on a surface and more specifically to a tab for use with a wedge to prevent misalignment or lippage of tiles and the like when being laid on the surface.

Description of Related Art Including Information Disclosed Under 37 CFR 1.97 and 1.98

Many tile and surface protective covering spacing and leveling devices and methods for using the same are known. Examples of such devices and methods are set forth in U.S. Pat. Nos. 7,992,354, 8,671,628 and 8,800,246. These prior art devices and methods for aligning tile and ensuring the edges of adjacent tiles are levelled include levelling devices having a base which is placed below the lower surfaces of two adjacent tiles. The base has a vertical member extending upwardly therefrom and inserted between side edges of the two tiles. The vertical member includes an opening therein and is attached to the base by one or more frangible connections in various positions on the vertical member. The frangible connections are broken or snapped off after the adhesive holding the tiles is set and the wedge is removed, to remove the vertical member from between the tiles.

These known devices all use wedges that are inserted through the opening in the vertical member to press against the upper surfaces of the two tiles and push the tiles down against the surface on which they are being laid, to hold the tiles aligned and in place until set. These known devices tend to be expensive to use, have frangible connections in or above the base at different positions in relation to the side edges of the two tiles and do not always provide acceptable and consistent results without the use of additional spacers or other devices or tools.

Therefore, there still exists a need in the art for an improved wedge leveling system and the levelling device or tab used with the wedge to maintain the items being attached to a surface in place and in proper alignment, and which is easily broken off at a frangible connection, in the desired position, below the upper surface of the base to provide more consistent and improved results.

The wedge leveling system in this document is configured to allow tiles or the like to be easily mounted on opposite sides of the base of the levelling device, with a vertical member held between opposed edges of the tiles. A wedge is then inserted and tightly held in an opening in the vertical element, so as to maintain the tiles or the like in place until set, whereby the wedge may be used to break off an upper protruding portion of the levelling device extending between adjacent tiles or the like or the wedge is removed and the upper protruding portion of the levelling device is easily broken off by kicking or striking with a tool.

BRIEF SUMMARY OF THE INVENTION

The wedge levelling system will hereinafter be described solely in relation to its use with tiles. However, it is to be understood that the levelling system may be used with substantially any floor, wall or other surface to which a surface coverings or cladding material is to be applied to level tiles.

It is a general object of the present invention to provide an improved tile levelling system. It is a more particular object of the present invention to provide a tile leveling system with a levelling device or tab having an opening therein into which a wedge is inserted and held to press on the upper surfaces of adjacent tiles to properly align the edges thereof.

It is an object of the wedge leveling system for the tab of the levelling system is preferably made from a thermoplastic material and includes a base and a vertical member extending away from a central area of a top surface of the base. The base of the tab is readily inserted between adjacent tiles with the vertical member extending between opposed edges or ends of the tiles. The base may take any desired shape, but preferably includes side with spaced apart outer ends or feet which are beveled to allow the base to be more easily inserted under adjacent tiles that are being laid and one side with a single tab to form a tri-tab base.

It is another object of the wedge leveling system for the tab to includes a first opening formed between leg portions of the vertical member, as well as a second opening on the top portion. The leg portions have rounded lower ends attached to frangible elements held in the bottom of curved openings formed on the top surface of the base. The frangible elements may include small openings therein so as to be easily broken off below the top surface of the base, eliminating separation in the wrong location, after the tiles are set, by either rocking or striking the vertical member.

It is an object of the wedge leveling system for the tab to provide a knife edge on the top of the opening in the vertical member to more firmly and securely cooperate with grooves or ribs formed on an angled top surface of a wedge when inserted and held in the opening. The angled top surface is three angles with a relieved area on the sides of the central angle to allow for wedges of different types to be used.

It is another object of the wedge leveling system to provide a tile leveling system with a tab having a base with a vertical member having at least one opening therein, which vertical member is connected to the base by spaced legs having frangible lower portions. It is yet another object of the present invention to provide a tile leveling system with a tab that includes a wedge holding opening therein. It is a still further object of the present invention to provide a novel tile leveling system with a tab having an integrated design that is more diverse, easier to use, uses less material to make and which eliminates breaking away of the frangible lower portions in the wrong locations, when compared to available tile levelling devices.

It is still another object of the wedge leveling system to provide a levelling system comprising a tab having a three-footed base and a vertical member releasably attached to the base by frangible leg portions held in openings formed on a top surface of the base. The vertical member includes an opening formed between the leg portions and spaced so as to be above two adjacent tiles when the tiles are placed on the base on either side of the vertical member, which extends between adjacent ends or side edges of the tiles. When a wedge is inserted and held in the opening and presses down, the tiles are pushed downwardly toward a surface upon which they are being laid to properly align the edges thereof until the tiles are set. The wedge is then used to break off the vertical member, or the wedge is removed and the vertical member broken off at the frangible portions and removed.

It is still another object of the wedge leveling system to provide a levelling system comprising an opening for a leg from the base to fit into the opening between the frangible legs. The central leg is configured with a tab that equates to the thickness of the vertical member so the parts stack in a flat configuration. The tab is also sized to hold within the sides of the opening. The height of the opening is large enough so it does not limit the number of levelers that can be stacked.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

The objects and features of the wedge leveling system which are believed to be novel, are set forth with particularity in the appended claims. The present invention, both as to its organization and manner of operation, together with further objects and advantages, may best be understood by reference to the following description, taken in connection with the accompanying drawings, wherein:

Figure 8A:
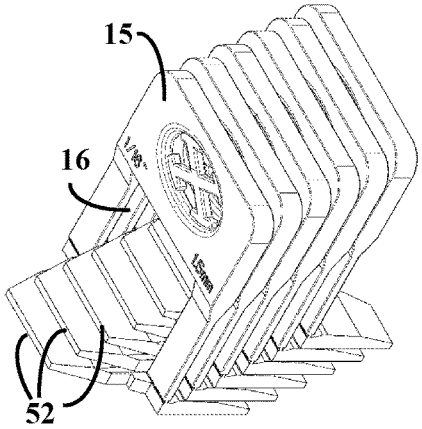

FIG. 8A a mated stack of 6 tabs.

Figure 8B:
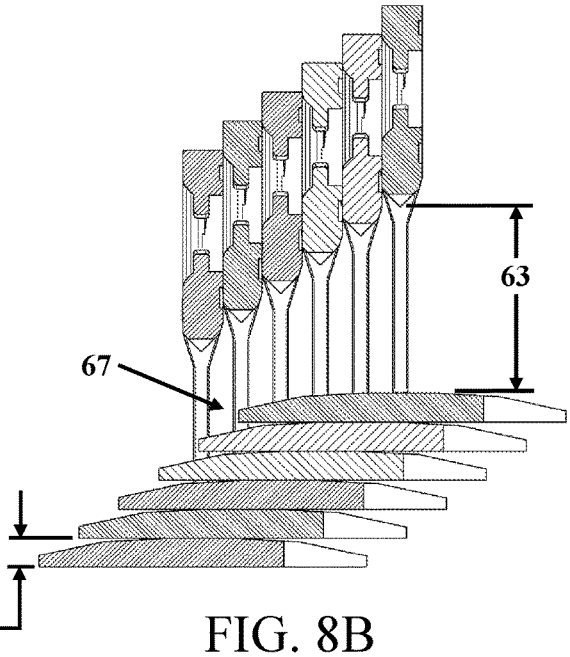

FIG. 8B a side cross-section of a stack of 6 tabs.

Figure 1:
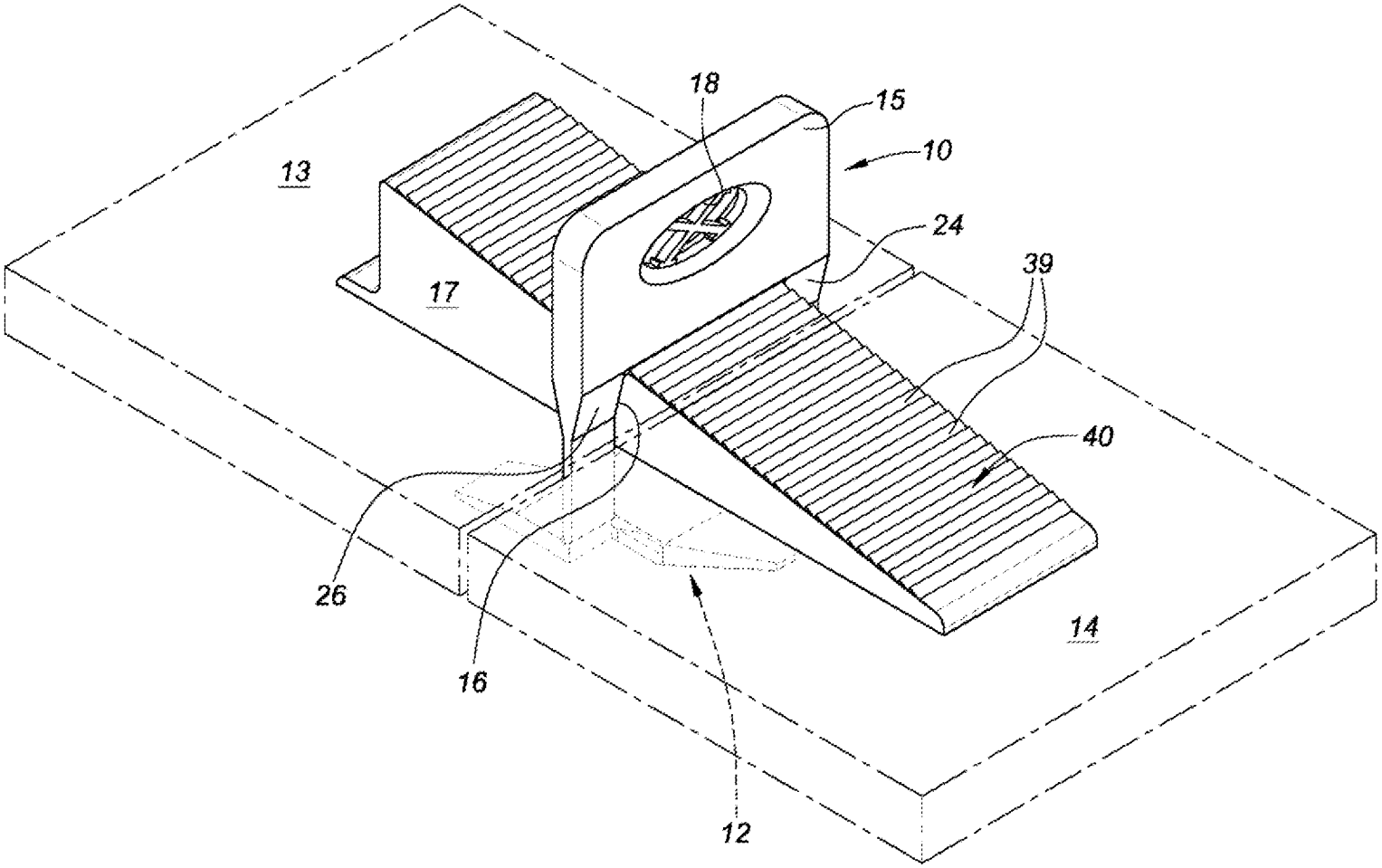
FIG. 1 is a perspective view of the wedge leveling system in an environment of use.
Figure 2A:
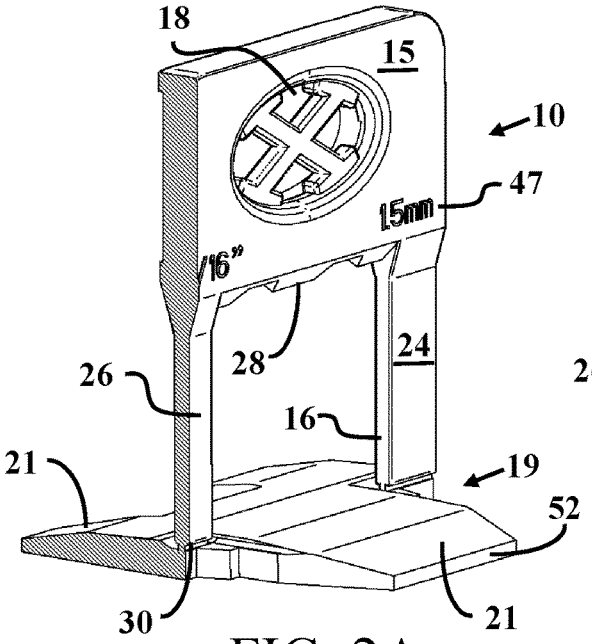
FIG. 2A is a front cross-section side perspective view of a preferred embodiment of the tab of the wedge leveling system.
Figure 2B:
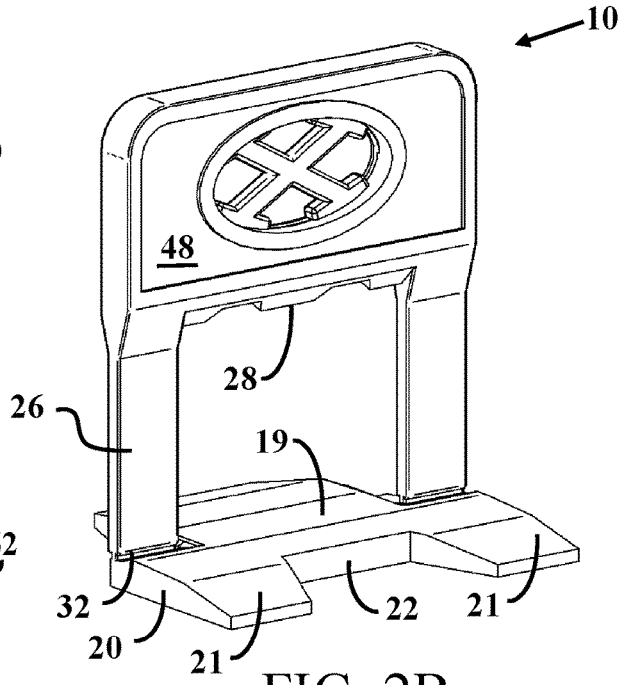
FIG. 2B is a rear perspective view of a preferred embodiment of the tab of the wedge leveling system.
Figure 3A:
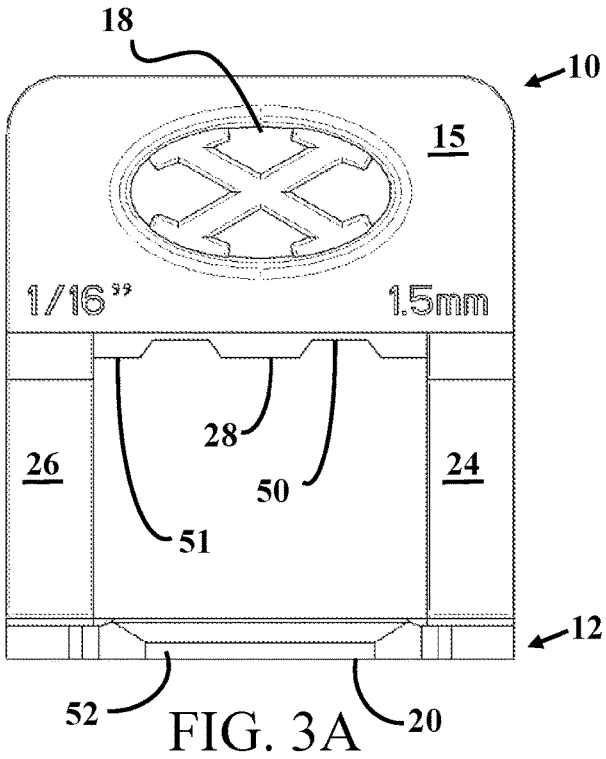
FIG. 3A is a front view.
Figure 3B:
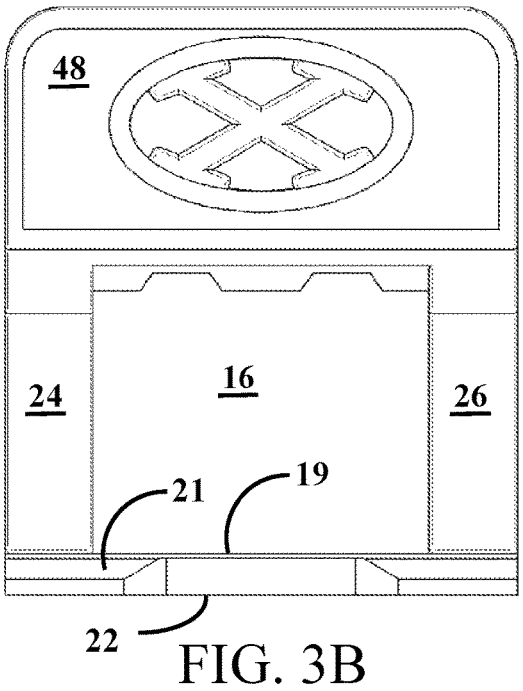
FIG. 3B is a rear view.
Figure 9:
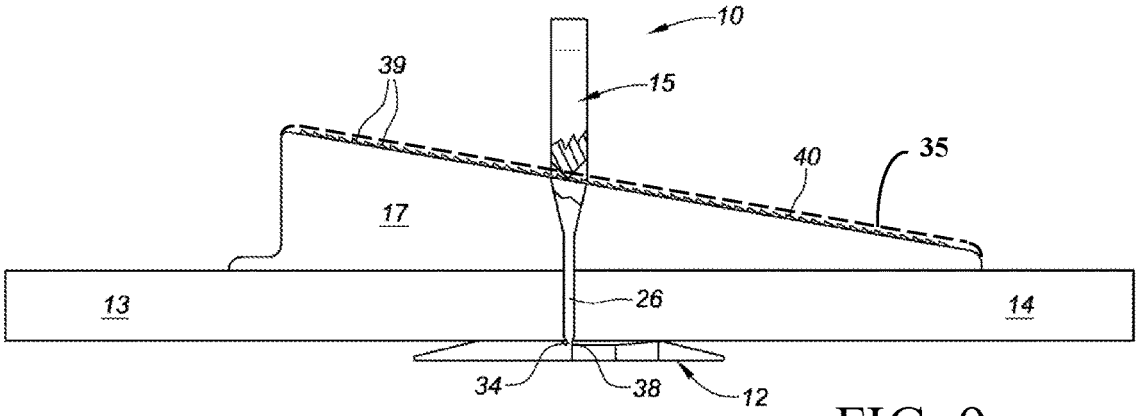

FIG. 9 is a side elevational view of a first side of FIG. 1, the other side being identical thereto.

Figure 10:
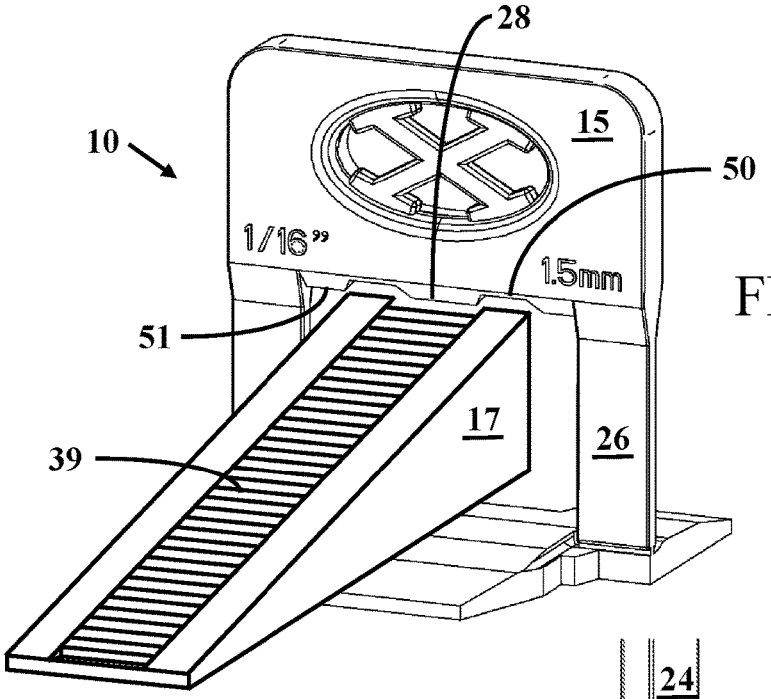

FIG. 10 shows a perspective view of the tab with an alternate version of a wedge.

Figure 11:
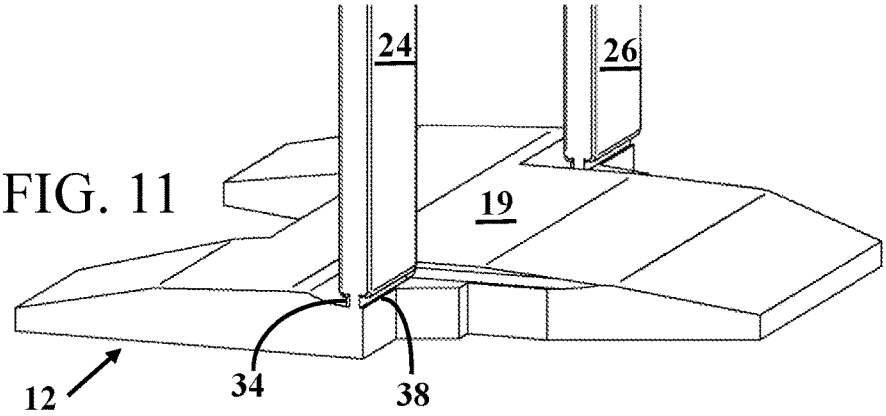

FIG. 11 is an enlarged partial side view of the frangible connection of a leg of the vertical member to the base.

DETAILED DESCRIPTION OF THE INVENTION

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

| Item Numbers and Description | |
|---|---|
| 10 tab | 12 base |
| 13 tile | 14 tile |
| 15 vertical member | 16 first opening |
| 17 wedge | 18 second bevel opening |
| 19 top surface | 20 bottom surface |
| 21 beveled top surfaces | 22 openings |
| 24 leg | 26 leg |
| 28 upper edge | 30 opening |
| 32 opening | 34 frangible portion(s) |
| 35 side lands | 36 openings |
| 38 rounded ends | 39 grooves or ribs |
| 40 upper angled surface | 47 indicia |
| 49 width | 48 recess |
| 50 relief(s) | 51 outer edge |
| 52 single foot | 53 taper |
| 54 side | 55 stop |
| 60 step | 61 thickness |
| 62 fit | 63 height |
| 64 thickness | 65 dimension |
| 66 thickness | 67 clearance |

Turning now to the drawings, FIG. 1, shows a perspective view of the wedge leveling system in an environment of use looking from above, showing two tiles 13 and 14 having a tab of the wedge leveling system with a base 12 inserted under adjacent ends or side edges and a vertical member legs 24 and 26 extending from the base 12 between the ends or side edges of the tiles 13 and 14. A wedge 17 is inserted and held in an opening formed through the vertical member legs 24 and 25 and presses down on the top surfaces of the two tiles 13 and 14 so as to align the edges and upper surfaces of the tiles 13 and 14.

This figure shows a preferred embodiment of a levelling device or tab 10 having a base 12 for mounting on a surface or substrate (not shown) under adjacent tiles 13, 14, with an adhesive or thinset applied to the surface to be covered and the lower surfaces of the tiles 13, 14. The tab 10 includes a vertical member 15 that is secured to the base 12 with a first opening 16 in the vertical member 15 that is adapted to receive a wedge 17, as described more fully herein below. The vertical member 15 may also include a second beveled opening 18 on a top portion thereof for easier gripping, handling and insertion under tiles. The second beveled opening 18 reduces material requirement and provides product recognition, such as a logo or identifying symbol or indicia regarding the tile spacing or other information. This top portion is also preferably expanded or thicker to provide additional rigidity when inserting the tab 10, thereby preventing bending or breaking.

As shown more clearly in other figures herein the base 12 includes a top surface 19 and a bottom surface 20, with spaced apart legs or feet 24, 26 with beveled top surfaces 21 on portions of the base 12 that are extending outwardly from either side of the vertical member 15. Openings 22 are formed in the base between the beveled legs or feet 21. The openings 22 allow the adhesive or thinset, between the surface being covered and the underside of the tiles 13, 14, to access both sides of the base 12 and provides better adhesion and eliminates bonding gaps that can cause tile breakage. Additionally, the openings 22 and the recess 48 provide lighter weight, less material used and faster mold cooling when fabricating from a plastic, or the like.

As best shown in FIGS. 2A, 2B, 3A and 3B, the vertical member 15 of the tab 10 has the first opening 16 formed therein between the window or first opening 16 between the two legs 24, 26 and an upper edge 28. The inner or lower ends of the legs 24, 26 are held in aligned openings 30, 32 that are formed in the top surface 19 of the base approximately along the centerline thereof by reduced width frangible portions 34. In a preferred embodiment, the openings 30, 32 are curved or rounded in profile with optional openings 32. The bottom surface 20 is flat and has a three-footed base with two feet on one-side that are split with an opening 22 and one foot 52 on the other side of the legs 24 and 26. The feet have a beveled top surface 21.

At the top of the window or first opening 16 are upper edges 28 and 51 with reliefs 50 at the sides of the upper edge 28. The relief (s) 50 provide clearance at the sides of the wedge 17, not shown in these figures. While a second bevel opening 18 and recess 48 is shown these are ornamental or cosmetic styling that can take a variety of styles without changing the functional aspect(s) of the tile leveling system. At least one face of the vertical member 15 can have indicia 47 that indicates the thickness of the legs 24, 26 for tile spacing.

Figure 4A:
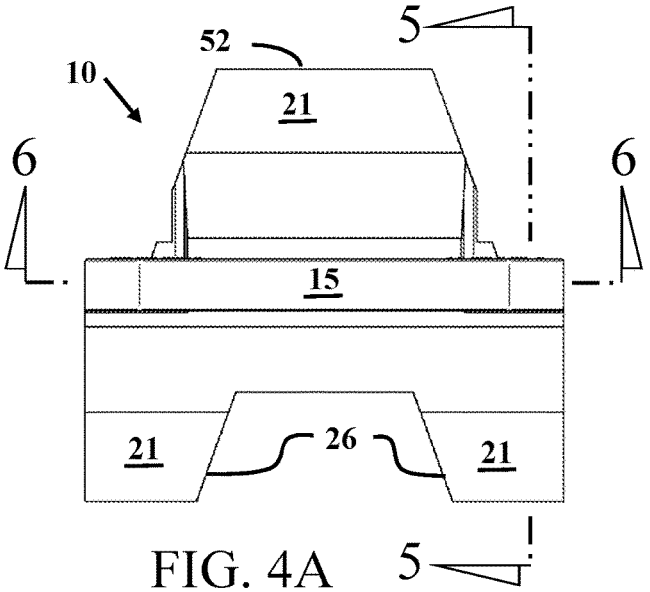
FIG. 4A is a top plan view.
Figure 4B:
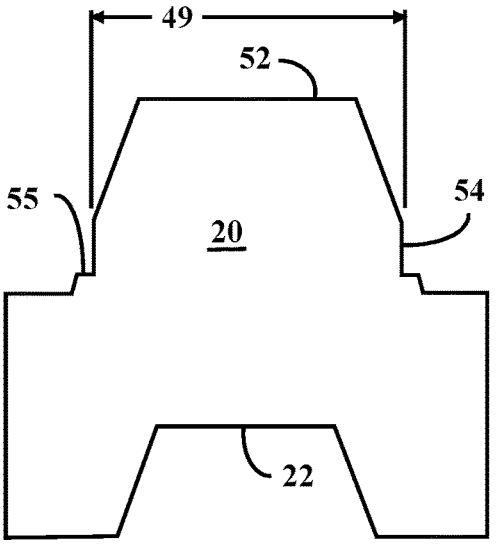
FIG. 4B is a bottom plan view.
Figure 5:
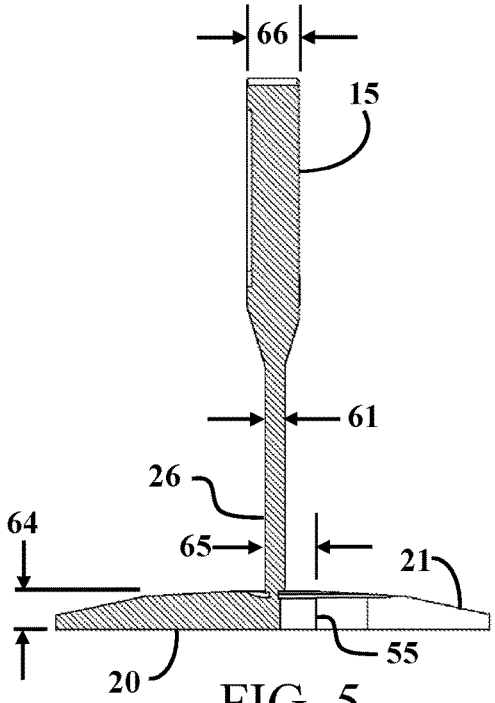
FIG. 5 is sectional view of a frangible connection of a leg of the vertical member to the base taken along line 5-5 of FIG. 4A.
Figure 6:
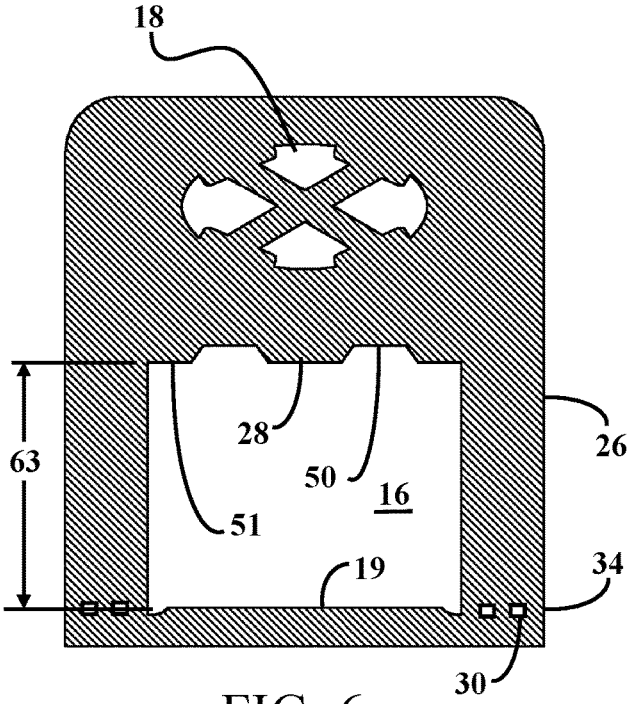
FIG. 6 is a front sectional view taken along line 6-6 of FIG. 4A.

FIG. 4A is a top plan view, FIG. 4B is a bottom plan view, FIG. 5 is sectional view of a frangible connection of a leg of the vertical member to the base taken along line 5-5 of FIG. 4A and FIG. 6 is a front sectional view taken along line 6-6 of FIG. 4A. The reduced width frangible portions 34 are formed below rounded ends 38 of the legs 24, 26 and have a plurality of openings 36 extending therethrough to allow the frangible portions to be more easily broken off, in the desired position, near the bottoms of curved openings 30, 32, when rocked or sufficient force is applied from either side of the tab 10, against the vertical member 15. In this embodiment, two openings 36 are shown but there could be more or less than two openings 36 in the frangible portions 34.

In use, as best shown in the figures, the tab 10 has its base 12 placed on a surface (not shown), such as floor or wall, with the bottom surface 20 of the beveled legs or feet of the base 12 under the lower surface of the tiles 13, 14 and with sufficient adhesive or thinset applied to the lower surface of the tiles and the surface to be covered by the tiles to allow the adhesive or thinset to enter the break point area and aid in holding the tab in place. The vertical member 15 is placed so as to extend upwardly between opposed ends or side edges of the tiles, to properly space the tiles apart and to allow the first opening 16 to receive the wedge 17 above the top surfaces of the adjacent tiles. The wedge is forced into the opening 16 until grooves or ribs 39, formed on an upper angled surface 40 of the wedge 17 to engage with and lock with the upper edge 28 of opening 16. In one embodiment of the wedge leveling system the upper edge 28 may be formed as a knife edge (FIG. 3) to more securely hold the wedge 17 in position by cooperating with grooves or ribs 39 and, therefore, more firmly press down on the top surfaces of tiles 13, 14 so as to align the opposing edges and prevent misalignment or lippage. It is to be understood that sufficient adhesive is placed on the lower surface of the tiles and the surface to be covered, to enable some of the adhesive to enter the openings 22 and flow onto the top surface 19 of the base 12 to aid in holding the base 12 on the supporting surface.

After the adhesive holding the tiles and base 12 in place sets, the wedge 17 is either removed or used to aid in breaking the vertical member 15 off in the base 12 by either hitting the wedge or removing the wedge and rocking the vertical member around the frangible portions 34 or hitting the upper end of the vertical member 15, above the top surface of the tiles, with a hammer or other tool, or by kicking the wedge and/or vertical member 15. The reduced width frangible portions 34 below the rounded ends 38 of the legs 24, 26 on the sides of the window or first opening 16 are broken off along the plurality of openings 36, essentially at or near the bottom of the rounded openings 30, 32. The rounded openings 30, 32 and rounded ends 38, as well as the openings 36, allow the frangible portions 34 to be broken off, in the correct location, at or near the bottom of the openings 30, 32, well below the top surface 19 of the base 12. After the vertical member 15 is broken off and removed, the space between the tiles is filled with grout. The grout also fills in the now empty rounded openings 38 in the base 12 to aid in keeping the base 12 in position underneath the lower surface of the tiles 13, 14.

The single foot 52 has a width 49 of the sides 54 that is configured to pass into the window or first opening 16. At the bottom portion of the single foot 52 have sides that are configured to mate with the insides of the legs 24, 26 and the thickness 64 of the base of the tabs 10 can infinitely stack with clearance at the leg 24, 26 thickness 61 dimension 65 within the inside height 63 of the window or first opening 16. A stop(s) 55 limit how far the single foot 52 can pass into the window or first opening 16. The dimension 65 of the stop 55 is the thickness 66 of the vertical member 15 so adjoining tabs 10 stack in a parallel relationship. At the top of the window or first opening 16 there is an upper edge 28 and 51 that has reliefs 50 for clearance of teeth on the sides of a wedge (not shown in this figure).

It, therefore, can be seen that the present wedge leveling system provides an improved levelling system comprising a tab having a base and a vertical member 15 releasably attached to the base 12 by frangible leg 24, 26 portions having a plurality of openings 22 formed therein and held in rounded openings formed on the top surface of the base 12. The vertical member 15 includes an opening spaced so as to be above two adjacent tiles when the tiles are placed on the base on either side of the vertical member 15 which extends between adjacent ends or side edges of the tiles 13, 14 to aid in spacing the same. A wedge 17 having an upper angled surface 40 with a number of grooves or ribs 39 that may then be inserted and more securely held in the first opening 16 to press down the tiles 13, 14 toward a surface upon which they are being laid to properly align the edges thereof until the tiles 13, 14 are set, the wedge 17 removed and the vertical member 15 broken off.

Figure 7A:
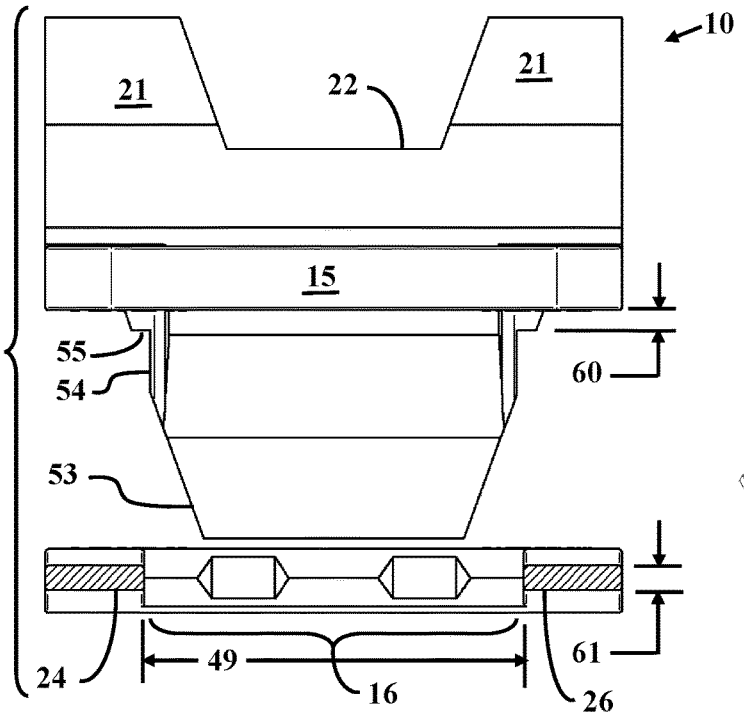
FIG. 7A shows two separated tabs.
Figure 7B:
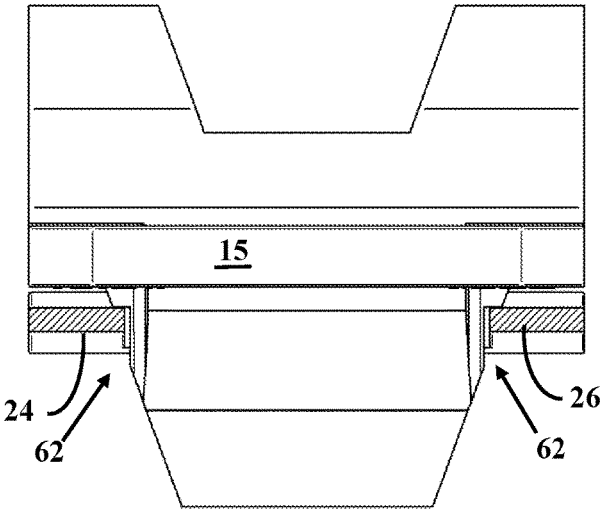
FIG. 7B shows two mated tabs.

FIG. 7A shows two separated tabs and FIG. 7B shows two mated tabs where the legs 24, 26 of one of the tabs is shows in cross-section. In FIG. 7B the fit 62 engages the sides 54 of the single foot 52 within the inside width 49 of the legs 24, 26. FIG. 8A a mated stack of 6 tabs and FIG. 8B a side cross-section of a stack clearance 67 of at least 6 tabs. The single foot 52 has a width 49 of the sides 54 that is configured to pass into the window or first opening 16. At the bottom portion of the single foot 52 have tapered 53 sides that are configured to mate with the insides of the legs 24, 26 and the thickness 64 of the base of the tabs 10 can infinitely stack with clearance at the leg 24, 26 thickness 61 dimension 65 within the inside height 63 of the window or first opening 16. The stop(s) 55 are limit by a step 60 that limits how far the single foot 52 can pass into the window or first opening 16. The dimension 65 of the stop 55 is the thickness 66 of the vertical member 15 so adjoining tabs 10 stack in a parallel relationship. At the top of the window or first opening 16 there is an upper edge 28 and 51 that has reliefs 50 for clearance of teeth on the sides of a wedge (not shown in this figure).

FIG. 9 is a side elevational view of a first side of FIG. 1, the other side being identical thereto and FIG. 10 shows a perspective view of the tab with an alternate version of a wedge 17. In these views the tiles 13 and 14 are placed on the sides of the leg 26 and the wedge 17 is inserted between the legs to force the tiles 13, 14 onto the top surface 19 of the tile leveler and the bottom of the wedge 17 will level the top surface of the tiles 13, 14. The grooves on ribs 39 engage in the upper edge 28. While some wedges 17 have grooves that pass across the entire upper surface of the wedge 17 so the three upper edges 28, 51 can all engage into a rib or groove, other versions have raised sides 35 on the outside of the wedge. The leveler has relief(s) 50 to allow for clearance of the raised sides 35.

FIG. 11 is an enlarged partial side view of the frangible connection of a leg of the vertical member to the base. After the adhesive sets, the tiles and base 12 in place, the wedge 17 is either removed or used to aid in breaking the vertical member 15 off in the base 12. The reduced width frangible portions 34 below the rounded ends 38 of the legs 24, 26 on the sides of the window or first opening 16 are broken off along the plurality of openings 36, at or near the bottom of the rounded openings 30, 32. The rounded openings 30, 32 and rounded ends 38, as well as the openings 36, allow the frangible portions 34 to be broken off, in the correct location, at or near the bottom of the openings 30, 32, below the top surface 19 of the base 12.

Various modifications, however, will remain readily apparent to those skilled in the art, since the generic principles of the present invention have been defined herein specifically to provide for a tile levelling system having an improved tab for insertion between two adjacent tiles so as to both space the tiles apart and cooperate with a wedge inserted into an opening in a vertical member of the tab to align the edges of the two tiles.

Thus, specific embodiments of a wedge leveling system have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A wedge leveling system for aligning surface for aligning surface coverings comprising:

a tab having a flat base with a bottom surface and a top surface with at least one window through said tab;

at least two vertical members frangibly secured in the top surface of the base and said at least two vertical members are separated by said window;

said base having a first side with at least two feet separated by at least one opening on one side of said tab at least one foot on an opposite side of said tab adapted to be inserted under lower surfaces of adjacent surface coverings to be aligned, with the vertical member extending between opposed edges or ends of said adjacent surface coverings to be aligned;

said vertical member being attached to the base by frangible portions;

said at least one foot having at least a portion that is sized to mate within said at least to two vertical members;

said at least one foot is configured to stack onto a least a second wedge leveler with said at least one foot passing through said second leveler;

said at least one foot has tabs on opposing sides of said at least one foot that are configured to mate within said second leveler;

said window is sized to accept a wedge adapted to be inserted and held in said window where the wedge is configured to press down the adjacent surface coverings toward a surface upon which the adjacent surface coverings are being laid, to align the edges, and said frangible portions of the vertical member are capable of being broken off, below the top surface of the base.

2. The wedge leveling system according to claim 1, wherein there is at least one opening in the frangible portions.

3. The wedge leveling system according to claim 1, wherein there are two openings in the frangible portions.

4. The wedge leveling system according to claim 1, wherein said at least one foot has tabs on opposing sides of said at least one foot that are configured to stack at least a second wedge leveler with said tab of said first wedge leveler being essentially parallel with a tab of said second wedge lever.

5. A wedge leveling system for aligning surface coverings, comprising:

a tab having a base with a bottom surface and a top surface;

at least two vertical member frangibly secured to the top surface of the base;

said base including two feet portions extending from one side of said base and a single foot extending from an opposite side of said base on opposite sides of the vertical member adapted to be inserted under lower surfaces of adjacent surface coverings to be aligned, with the vertical member extending between opposed edges or ends of said adjacent surface coverings to be aligned;

said at least two vertical leg members each having at least one frangible portion;

a first opening formed between said at least two vertical members above the top surface of the base having side edges formed by the leg portions of said vertical member and a top edge substantially parallel to the top surface of the base;

said top edge having at least one relief on at least one side of said top edge that increases a height within said first opening.

6. The wedge leveling system according to claim 5, wherein said vertical member includes an expanded top portion and a beveled second opening formed therein, above the first opening, to allow easy gripping and for holding identifying matter.

7. The wedge leveling system according to claim 5, that is configured for a wedge adapted to be inserted and held in the first opening in the vertical member where the wedge is configured to press down the adjacent surface coverings toward a surface upon which the adjacent surface coverings are being laid, to properly align the edges thereof and said wedge including an angled top surface with a plurality of ribs formed thereon, and the top edge of the at least one opening being formed as a knife edge for cooperating with the plurality of ribs formed on the angled top surface of the wedge.

8. The wedge leveling system according to claim 7, wherein said at least one relief on at least one side of said top edge is configured to accept a wedge where said plurality of ribs do not extend across a width of said wedge.

9. The wedge leveling system according to claim 6, wherein said top edge has at least three knife edges.

10. The wedge leveling system according to claim 7, wherein said first opening has side edges sized to mate with sides of said single foot therein.

* * * * *